US005509544A

United States Patent [19]

Osborn

[11] Patent Number: 5,509,544

[45] Date of Patent: Apr. 23, 1996

[54] RACK APPARATUS FOR DRYING MULTIPLE RIGID, PAINTED OBJECTS

[75] Inventor: Harry C. Osborn, Erie, Pa.

[73] Assignee: HOBO Manufacturing Company Incorporated, Erie, Pa.

[21] Appl. No.: 325,080

[22] Filed: Oct. 19, 1994

[51] Int. Cl.[6] ..... A47B 47/00

[52] U.S. Cl. ..... 211/190; 211/134; 248/201

[58] Field of Search ..... 211/190, 41, 208, 211/191, 194, 206, 134; 118/500; 248/201

[56] References Cited

U.S. PATENT DOCUMENTS

| | | | |
|---|---|---|---|
| 1,269,351 | 6/1918 | Wendelius . | |
| 1,393,054 | 10/1921 | Turner | 211/190 |
| 1,563,057 | 11/1925 | Williams | 211/134 |
| 4,032,165 | 6/1977 | Russell | 280/79.3 |

*Primary Examiner*—Leslie A. Braun
*Assistant Examiner*—Anita M. King
*Attorney, Agent, or Firm*—James Creighton Wray

[57] ABSTRACT

The present invention is a rack apparatus for drying multiple rigid, painted objects. The apparatus is made up of two identical racks. Each rack has a base, to which is attached two vertical bars, perpendicular to the base, which have in between them a horizontal handle for carrying. Attached to the vertical bars are vertical posts, extending in a direction perpendicular to the base. Each post has multiple hooks which support horizontal poles. When disassembled, the poles and posts can be placed in pole storage holders, which are connected to the base. This allows for the apparatus to be easily transported and space efficient. The apparatus functions by placing the two racks on opposite ends of the rigid object. Spikes are driven into the upper and lower ends of a door or other rigid object. The spikes support the door on spaced sawhorses, where the door is painted. After the painting is complete, the door can be lifted by the spikes and carried to the apparatus, where the door is placed in the apparatus to dry by resting the spikes on the horizontal poles. This invention allows the drying of several doors or other rigid objects simultaneously in the same area and allows for the entire object to be painted at one time. The present invention can also be used as a storage apparatus for holding multiple doors or other rigid objects in showrooms and warehouses, instead of stacking and leaning them against walls, which many times results in surface damage to the doors or rigid objects. Multiple rack assemblies can also be incorporated into a workbench saw table.

17 Claims, 4 Drawing Sheets

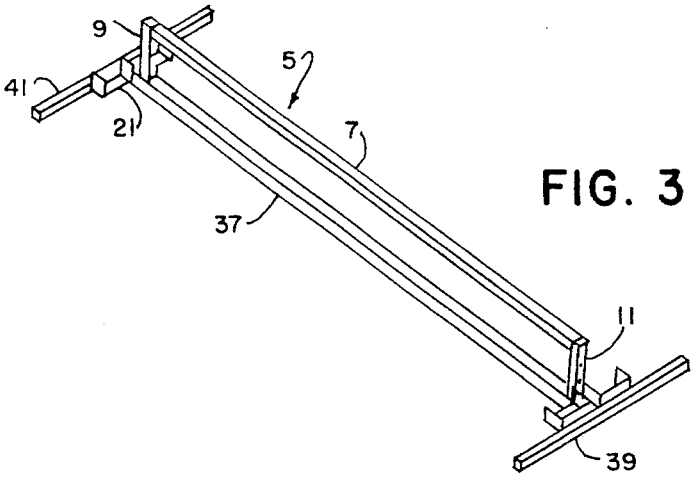
FIG. 3
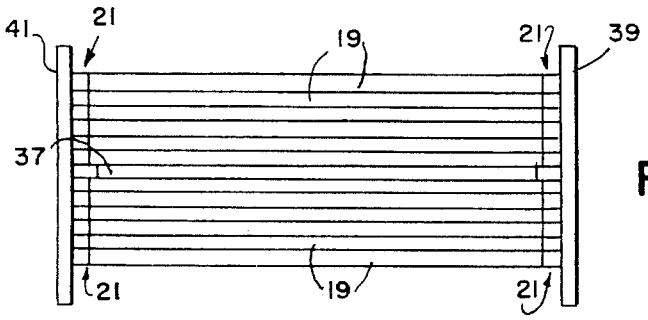
FIG. 4
FIG. 5
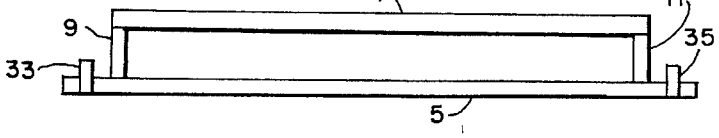
FIG. 6
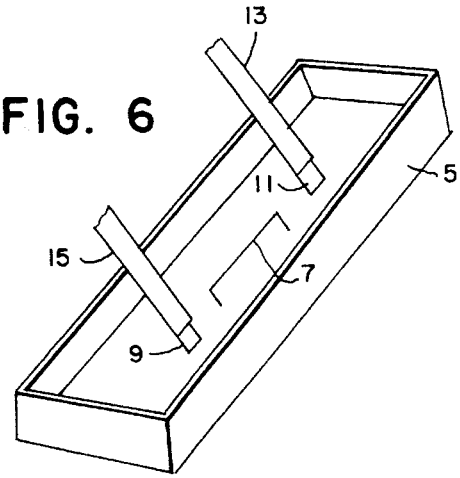
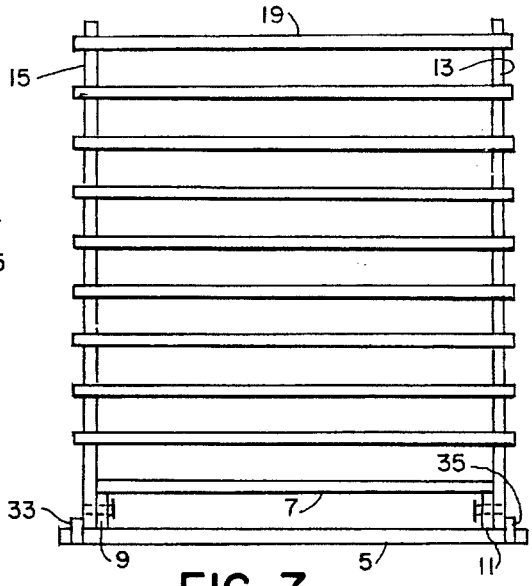
FIG. 7

RACK APPARATUS FOR DRYING MULTIPLE RIGID, PAINTED OBJECTS

BACKGROUND OF THE INVENTION

It is the practice of good painters to remove doors from their hinges and paint them lying down. This prevents the paint from running and sagging. As anyone who has painted a detached door, window, trim, or other rigid object can attest, one of the most irritating and time consuming parts of this job is waiting for the paint to dry so that the object can be rotated and the painting completed. At the present time, objects, such as doors, are straddled across two sawhorses and painted. Unfortunately, there will always be a part of the object which rests directly on the sawhorse and thus cannot be reached with a paint brush. The painter is left to wait for the object to dry, and then, after the delay, the painter can rotate the object and finish the paint job. This wastes valuable time and creates a considerable inconvenience. A second problem confronting painters, builders and carpenters relates to the use of the sawhorse itself. Sawhorses are big, bulky and not amenable to quick assembly and disassembly. This makes transporting sawhorses difficult, and requires a truck or van for safe conveyance. Another drawback of the sawhorse is that a pair of sawhorses can support only one door or window at a time. This slows down the painting process and increases the possibility of imperfections in the paint job, since the window, door or trim will have to be moved a number of times and leaned against walls and other objects if enough sawhorses are not available to hold the freshly painted objects.

A third problem faced not only by painters, builders and carpenters, but also by manufacturers and salesmen of windows and doors, is that damage frequently occurs to the products because of the inherent nature of stacking and the leaning of the products against walls. No matter how careful the individual is, scratches and marks inevitably appear, thus rendering the product less desirable.

A long standing need has existed for an easily transportable apparatus which will allow multiple freshly painted objects to be dried. The present invention describes and claims a rack apparatus and its methods of use which satisfy this long standing need.

SUMMARY OF THE INVENTION

The present invention provides methods and apparatus for drying multiple rigid, painted objects, such as doors, windows and trim. The invention uses two identical rack assemblies set up at an appropriate distance from each other to accommodate the items being dried. Each rack assembly has a base, two vertical bars attached to opposite sides of the base and parallel to each other, and two vertical posts, each of which are connected to a vertical bar. Each post is fitted with multiple hooks which are positioned on each post in corresponding intervals. These hooks serve to support horizontal poles, which rest across the hooks.

The preferred embodiment of this invention includes a base having a crossbar with a first end and a second end, a first perpendicular bar attached to the first end, and a second perpendicular bar attached to the second end, thus creating an I-shaped configuration of the base. It also has four pole storage holders connected to the base on opposite corners of the crossbar.

A second embodiment of the present invention includes a tray as the base. In this embodiment, the carrying handle is directly connected to the tray, and the vertical posts and horizontal poles can be placed in the tray when disassembled.

A third embodiment of the apparatus involves the placement of the hooks in the post in a staggered pattern—alternating between having the hook extend inward towards the other rack, and the next facing outward, away from the rack assembly. This provides for a balanced apparatus which is less susceptible to caving in due to the weight of the objects supported.

A fourth embodiment of the present invention uses horizontal pins to connect each vertical bar to its adjacent vertical post. Holes can be drilled in both the vertical bars and the vertical posts, thus permitting a horizontal pin, such as a bolt, to extend completely through both members and thus secure them to each other. This could be effected by placing the post next to the vertical bar and having the pin extend through the widths of both members. An alternative means for connecting the vertical bars to the vertical posts is to fit each vertical post over a vertical bar and having a pin extend through the vertical bar and vertical post. In this embodiment a smaller pin, which is slightly longer than the width of the vertical bar, can be used.

The rack assemblies can be incorporated into a workbench saw table. Poles equipped with holes for receiving pins can be laid across hooks. A plywood board is then attached securely to the assemblies by inserting pins through the board and the poles.

The present invention functions in the following manner. Spikes are driven into a rigid object, such as a door, in opposite ends. The object can then be painted, in its entirety, on a sawhorse, since only the stakes, and no portion of the object, touch the sawhorse. Upon completion of the paint job, the painted object is placed in the rack apparatus by resting the spikes on the horizontal poles. Successive items can be dried on the apparatus at the same time simply by resting the spikes on different horizontal poles. Thus, the invention saves time by allowing both sides of the item to be painted in succession, without a drying period in between, and limits the possibility of imperfections and scratches in the paint job. In addition, instead of one object being dried at a time per every two sawhorses, numerous objects can be dried at once by using only two rack assemblies (one rack apparatus).

The present invention has the added value of being easily transportable. The rack can be easily assembled and disassembled, requiring at most the tightening or loosening of a few pins. Also, each rack assembly is equipped with an even multiple of pole storage holders, attached to the base, in which the poles and posts can be placed during transport. In addition, each rack is equipped with a handle, connected to the base, which can be used to carry the disassembled rack apparatus. These features not only allow for ease in delivery to the job site, but also allow more racks to be transported in smaller vehicles.

The present invention is much lighter and more easily carried than a sawhorse. This is a distinct advantage for painters in multiple story houses and buildings. A painter can set up in a room, remove all doors, windows and trim, paint the objects, and place them on the rack apparatus to dry without any downtime or delay and without removing the object from the room.

In addition to being useful as a drying apparatus, this invention can also used by salesmen and manufacturers in stores showrooms, and storage areas. The apparatus itself is capable of holding multiple items, and does so without resting them directly against a surface, such as a wall, the ground, or another item, which can cause scratches, blemishes and other marks. This will result in a profit to the businesses selling the products because less items will be returned or deemed unusable due to imperfections.

These and further and other objects and features of the invention are apparent in the disclosure, which includes the above and ongoing written specification, with the claims and the drawings.

The invention providing each rack assembly with vertical bars welded to a base and the base including a handle. Each rack assembly having the base, vertical bars, vertical posts, horizontal poles, hooks, and handle being made of steel.

BRIEF DESCRIPTION OF THE DRAWINGS

FIG. 3 an illustration of one possible embodiment of the base of the rack assembly.

FIG. 4 is a plan view of the base embodiment of FIG. 3.

FIG. 5 is an illustration of a second embodiment of the present invention, where a tray is the base and the each vertical post fits over a vertical bar.

FIG. 6 is illustration of a third embodiment of the is an base which inches the left and right stanchions.

FIG. 7 shows the rack assembly having a base with stanchions.

DETAILED DESCRIPTION OF THE DRAWINGS

Figure 1:
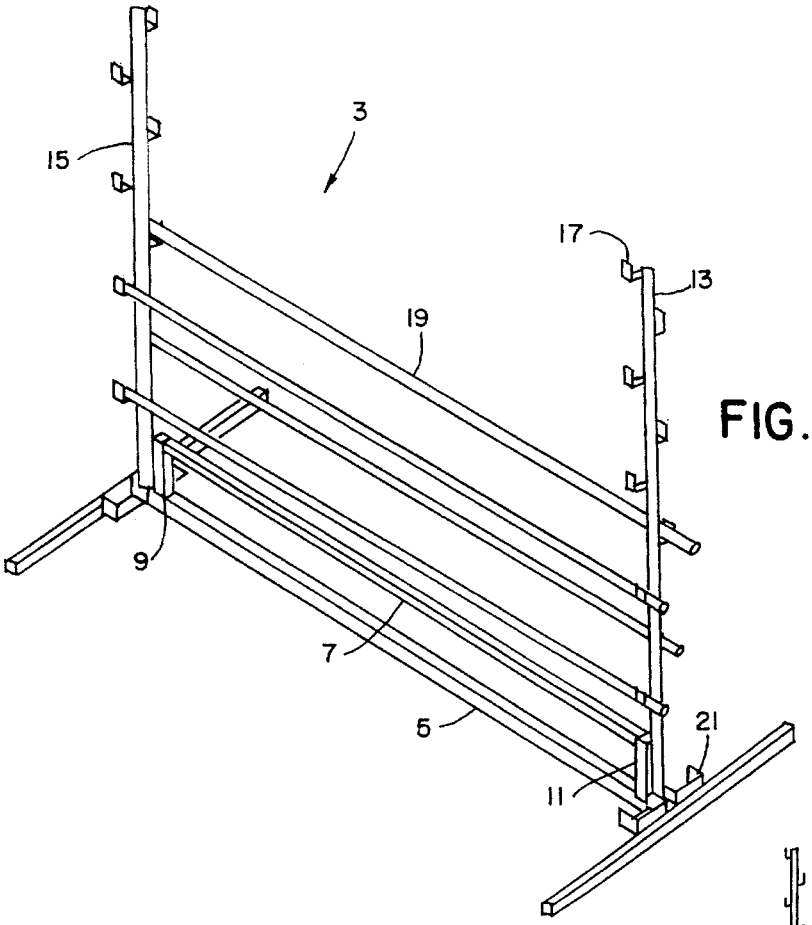
FIG. 1 is an illustration of a rack assembly which, with a second identical rack assembly, constitute the rack apparatus for drying multiple rigid, painted objects.
Figure 2:
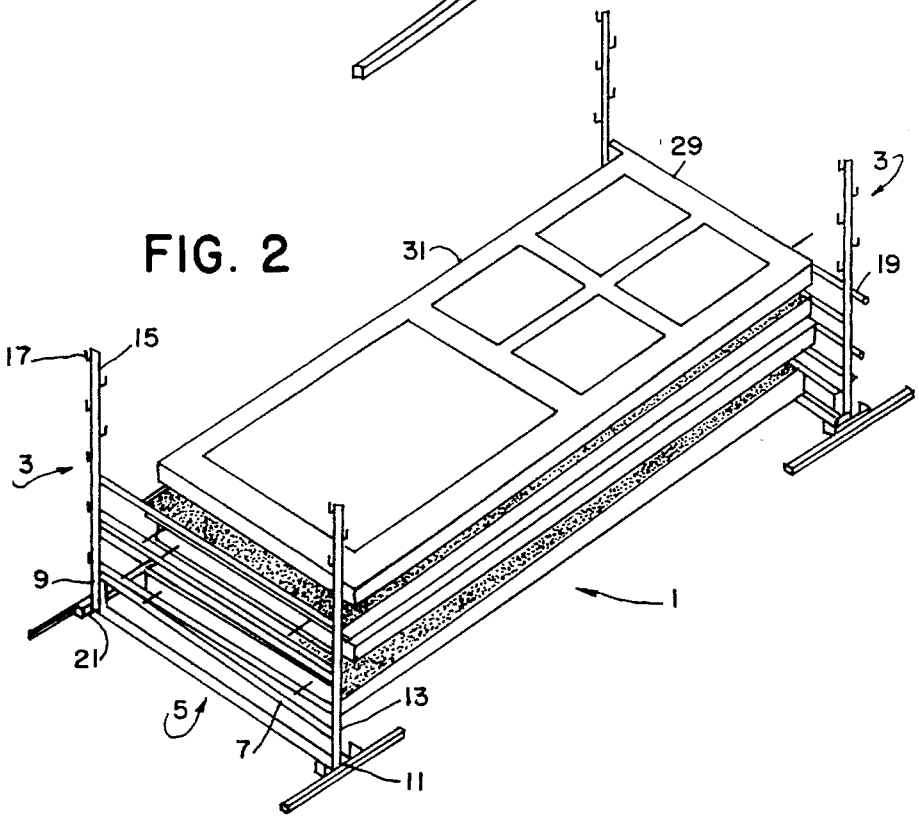
FIG. 2 shows the rack apparatus in use.

The present invention, as shown in FIGS. 1 and 2, is a rack apparatus 1 composed of two identical rack assemblies 3 which can be used for drying one or more doors 31 or other rigid painted objects. Each rack assembly has a base 5. Two vertical bars 9 and 11 are attached to the base 5 and support a handle 7 in between them. Two vertical posts 13 and 15 are each connected to a vertical bar 9 or 11. The posts have multiple hooks which support horizontal poles 19. Spikes 29 are inserted in the upper and lower ends of the door 31 or other rigid painted object. These spikes 29 rest on the horizontal poles 19 when the door 31 or other rigid object is placed in the rack apparatus 1 to dry.

More specifically, FIG. 1 is an illustration of a rack assembly 3 which, when used in conjunction with a second rack assembly 3, form the rack apparatus 1. Each rack assembly 3 has a base 5, connected to which are a right vertical bar 11 and a left vertical bar 9. A handle 7, which can be used for carrying the rack assembly when it is disassembled, lies in between and is connected to both the right vertical bar 11 and the left vertical bar 9 and is horizontal to the base 5. Also, detachably secured to each vertical bar 9 or 11 is a post—a first vertical post 13 detachably secured to the right vertical bar 11 and a second vertical post 15 detachably secured to the left vertical bar 9. Connected to both the first vertical post 13 and the second vertical post 15 are a number of hooks 17, across which are laid a horizontal pole 19. The preferred embodiment of the present invention have the hooks 17 staggered, alternating between opposite sides of each post 13 and 15. This gives the present invention greater stability and reduces the possibility of collapse due to the weight of the objects being dried. This illustration also shows the four pole storage holders 21, connected to the base 5, into which the vertical posts 13 and 15 and horizontal poles 19 can be placed when the rack assembly 3 is disassembled. This allows for ease in transporting the rack assembly 3, since it requires only one hand to carry and takes up minimal space in the vehicle.

FIG. 2 shows the present invention in use. Two identical rack assemblies 3 are positioned an appropriate distance from each other to accommodate the doors 31 or other painted rigid objects to be dried. Spikes 29 are driven into the upper and lower ends of the door 31 or other painted rigid object. The door 31 can then be placed on a sawhorse and the entire surface can be painted. Once painting is completed, the door 31 or other painted rigid object can be lifted by its spikes 29 and positioned in between the two rack assemblies 3. The spikes 29 are rested on the horizontal poles 19, thus preventing any portion of the door 31 or other painted rigid object from touching the rack apparatus 1. This has the advantage of allowing the entire rigid object 31 to be dried without disturbing any of the painted surfaces, and eliminating the need to "touch up" or repaint the rigid object 31. Each door 31 or painted rigid object only uses one horizontal pole 19 from each rack assembly 3, thus allowing multiple doors and other painted rigid objects 31 to be dried simultaneously, the exact number to be determined by the number of hooks 17 in each vertical post 13 or 15.

FIG. 3 is an illustration of one possible embodiment of the base 5 of the rack assembly 3. This embodiment has an I-shaped configuration, made up of a horizontal crossbar 37 and two perpendicular bars 39 and 41, a first perpendicular bar 39 connected to the first end of the crossbar 37 and the second perpendicular bar 41 connected to the second end of the crossbar 37. This configuration gives the rack assembly 3 greater balance and minimizes the likelihood of the rack assembly 3 toppling. The pole storage holders 21, connected to the base 5 on opposite sides of the crossbar 37, make carrying the disassembled rack assembly 3 easier since the weight will be equally dispersed when the rack assembly 3 is lifted by its handle 7.

FIG. 4 is a plan view of the embodiment of the base 5 described in FIG. 3. This illustration shows the balanced construction of the base 5. The handle 7 is directly above and parallel to the crossbar 37. The first perpendicular bar 39 and second perpendicular 41 bar are of equal length, and are attached to the crossbar 37 at the center of each. Each pole storage holder 21 can hold one end of at least six poles 19 or posts 15. Preferred embodiments of the present invention have four pole holders 21 in each base 5, with each pair of pole holders 21 capable of carrying six poles 19 or posts 15.

FIG. 5 is an illustration of a second embodiment of the base 5, having a left stanchion 33 and a right stanchion 35. Each stanchion 33 or 35 are connected to opposite sides of the base 5. The left stanchion 33 is positioned between the left vertical bar 9 and the end of the base 5, and the right stanchion 5 is positioned between the right vertical bar 11 and the opposite end of the base 5. The space between each stanchion 33 or 35 and vertical bar 9 or 11 is an area where a vertical post 13 or 15 can be received.

FIG. 6 shows a third embodiment of the rack assembly 3. In this embodiment, the base 5 is a tray, having a rectangular bottom four sides, and an open top. A handle 7 is attached directly to the base 5. Two vertical bars 9 and 11 are also attached directly to the base 5. A first vertical post 13 is fitted over the right vertical bar 11 and a second vertical post 15 is fitted over the left vertical bar 9.

FIG. 7 is an illustration of an assembled rack assembly 3 which has a base with stanchions 33 and 35, as introduced in FIG. 5. A vertical post 13 or 15, which is connected to a vertical bar 9 or 11, fits snugly between the vertical bar 9 or 11 and a stanchion 33 or 35, thus giving the vertical post 13 or 15 added support. The stanchion 33 or 35 takes stress off the vertical post 13 or 15 and prevents the means of connecting the vertical post 13 or 15 to the vertical bar 9 or 11 from becoming attenuated.

Figure 8:
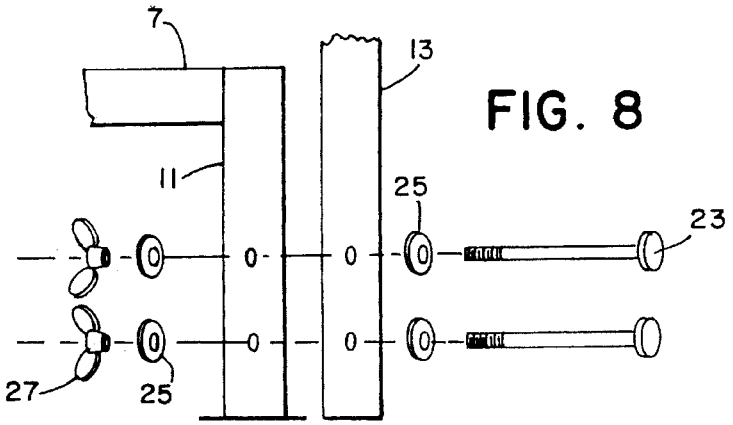
FIG. 8 s a possible means for connecting a vertical bar to a vertical post by using bolts, wing nuts and washers.

FIG. 8 is an illustration of a preferred means for connecting a vertical post 13 or 15 to a vertical bar 9 or 11. In this embodiment, two holes are drilled in lower portion of each of the first vertical post 13 and right vertical bar 11. A bolt 23 is extended through the top holes of both the first vertical post 13 and the right vertical bar 11; similarly, a second bolt 23 is extended through the bottom holes of both the first vertical post 13 and the right vertical bar 11. One washer 25 is positioned over the hole where the bolt 23 enters the first vertical post 13 and a second washer 25 is placed over the hole in the right vertical bar 11 where the bolt 23 exits. A wing nut 27 is secured on the end of the bolt 23, up against the second washer 25. A second vertical post 15 and a left vertical bar 9 can be connected in an identical manner. This means for connecting a vertical post 13 or 15 to the vertical bar 9 or 11 is advantageous because it creates a secure fit which is not likely to release under pressure. In addition, this means makes the rack assembly 3 easy to assemble and disassemble.

Figure 9:
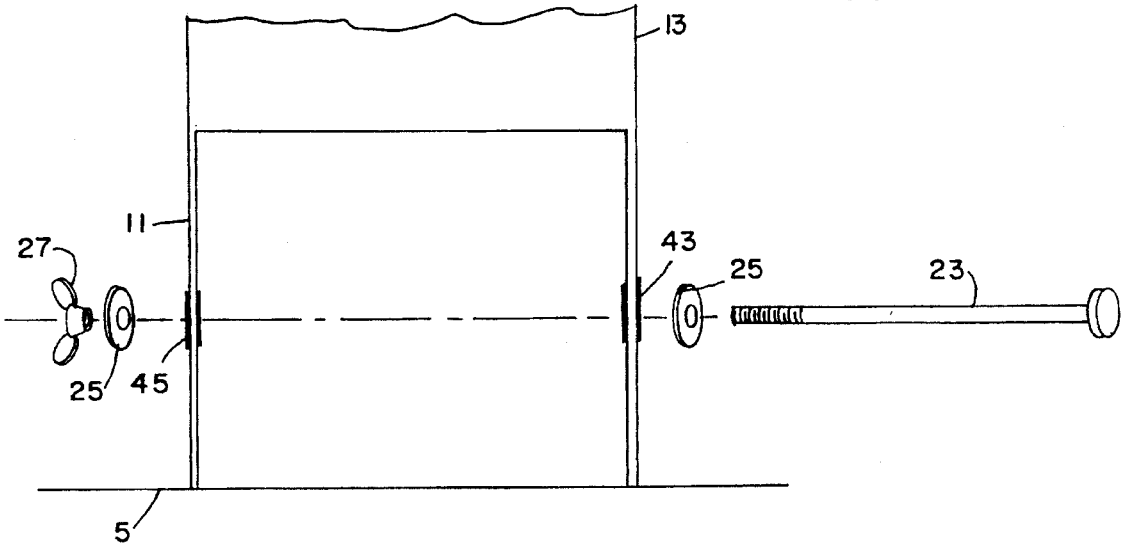
FIG. 9 is an illustration of the embodiment of the invention where the vertical post is fitted over a vertical bar and secured to the vertical bar by using bolts, wing nuts

FIG. 9 shows the same connecting means described in FIG. 8 being implemented in the embodiment of the invention shown in FIG. 6. In this embodiment, the bolt 23 would extend first through the outer hole 43 of the first vertical post 13. The bolt 23 continues through the right vertical bar 11 and exits through the inner hole 45 of the first vertical post 13. A first washer 25 is placed over the outer hole 43 where the bolt 23 enters the first vertical post 13 and a second washer 25 is placed over the inner hole 45 in the first vertical post 13 where the bolt 23 exits. A wing nut 27 is secured to the end of the bolt 23, up against the second washer 25. A second vertical post 15 and a left vertical bar 9 can be secured in an identical manner.

Figure 10:
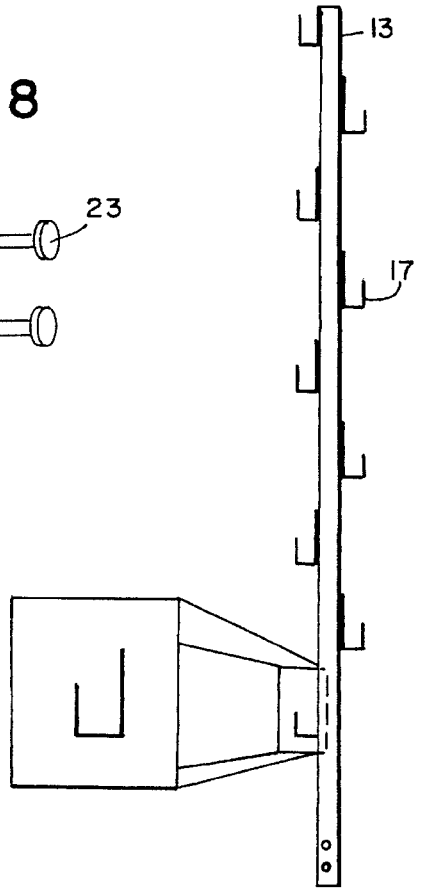
FIG. 10 shows a fourth embodiment of the rack assembly having an alternating hook pattern.

FIG. 10 is an illustration of a vertical post 13 or 15 in the preferred embodiment of the rack assembly 1 or 3. The hooks 17 are connected to the first vertical post 13 in a staggered pattern, alternating between opposite sides of the first vertical post 13. The hooks 17 are curved upward so that they can securely support a horizontal pole 19. The hooks 17 can be positioned on the second vertical post 15 in an identical manner. By staggering the hooks 17 as such, the rack apparatus 1 is made more stable and balances the weight as multiple doors 31 and other painted rigid objects are placed in the rack apparatus 1.

Figure 11:
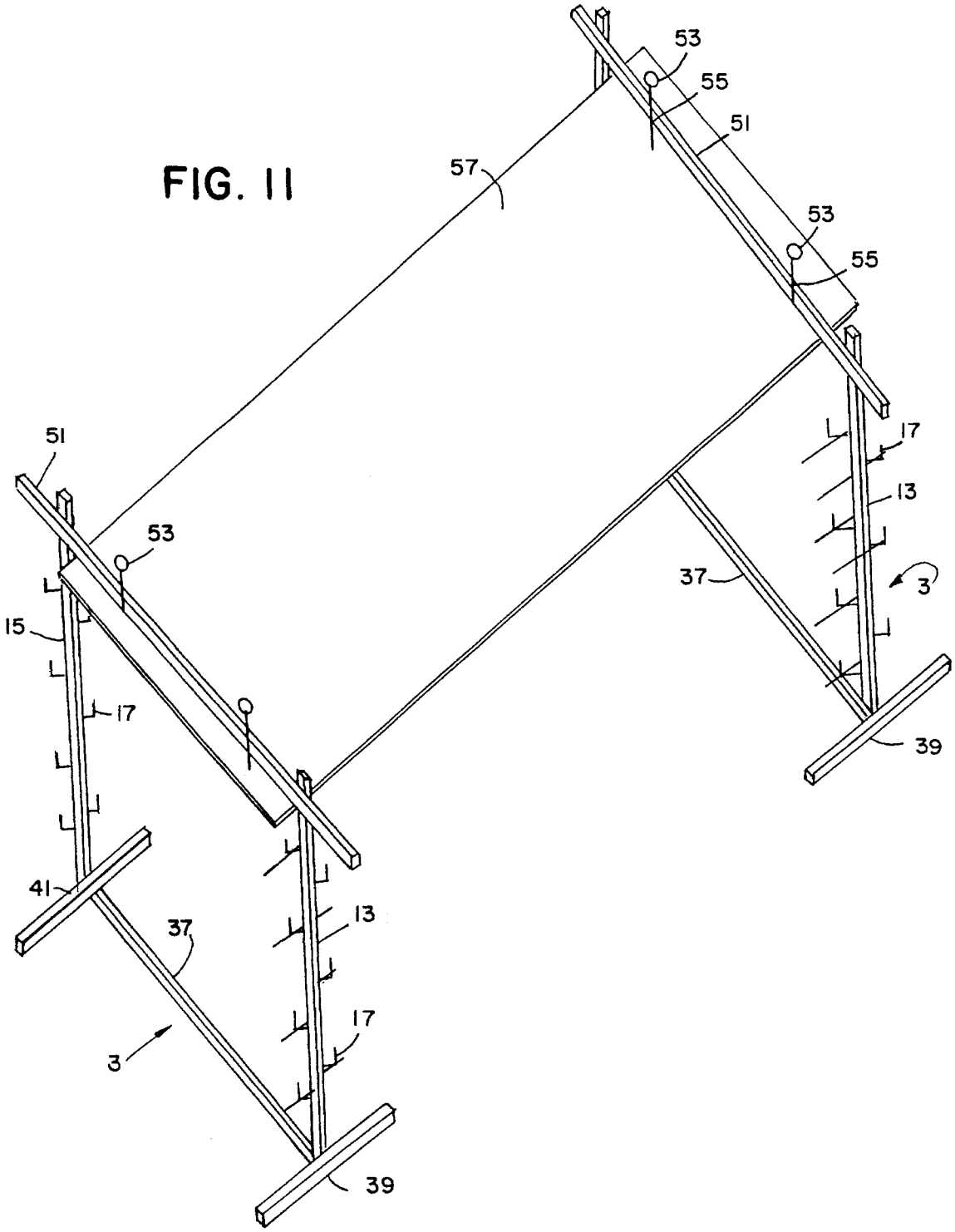
FIG. 11 shows a workbench saw table having a pair of rack assemblies as its base.

FIG. 11 shows a preferred embodiment of the rack assembly 3 incorporated into a workbench saw table. Two rack assemblies 3 are positioned an appropriate distance from each other. A square tube 51 is laid across hooks 17 in the vertical posts 13, 15 of each rack assembly 3. Each square tube 51 has holes 55. Connecting pins 53 are extended through the holes 55 in the square tube 51 and into a plywood board 57 that extends between the two rack assemblies 3.

The present invention solves all of the problems present in the prior art. First, the present invention allows the painters, carpenters and builders to limit time delays by providing an apparatus which can hold a multiple number of rigid objects to dry. Repainting and touch up painting is no longer needed because the object will be able to be completely painted and dried without touching a foreign surface, such as the ground or a wall.

The ease of transport and assembly and disassembly alleviates the transport problems presented by sawhorses. Smaller vehicles can be used to transport the drying apparatus, and multiple rack assemblies can fit in the area occupied by one sawhorse.

The present invention limits damage to the rigid object which habitually occurs when the objects are stacked or leaned against a wall. The door or other rigid object will be handled by spikes inserted in its upper and lower ends, and the door itself never comes into contact with any surface.

The present invention can also perform any other functions previously performed by the sawhorse.

While the invention has been described with reference to specific embodiments, modifications and variations of the invention may be constructed without departing from the scope of the invention, which is defined in the following claims.

I claim:

1. A rack apparatus for drying multiple rigid, painted objects, the rack apparatus comprising first and second rack assemblies, each rack assembly further comprising a base; a left vertical bar and a right vertical bar connected to the base; a horizontal handle, with a left end and a right end, the left end connected to the left vertical bar and the right end connected to the right vertical bar; a first vertical post and a second vertical post, the first vertical post detachably secured to the right vertical bar, and the second vertical post detachably secured to the left vertical bar; multiple hooks, with an equal number of hooks attached to the first post and to the second post; and multiple horizontal poles, each pole supported by more than one hook.

2. The apparatus of claim 1, wherein each rack assembly further comprises said handle connected directly to the base.

3. The apparatus of claim 1, wherein each rack assembly further comprises a horizontal crossbar having a first end and a second end, a first perpendicular bar connected to the first end, and a second perpendicular bar connected to the second end, the first and second perpendicular bars being parallel to each other.

4. The apparatus of claim 1, wherein each rack assembly further comprises a tray a its base.

5. The apparatus of claim 1, wherein each rack assembly further comprises a left stanchion and a right stanchion attached to the base in positions such that each of the vertical posts fits snugly between one of the stanchions and one of the vertical bars.

6. The apparatus of claim 1, wherein each rack assembly further comprises multiple pole storage holders connected to the base for storing and carrying the vertical posts and horizontal poles when the apparatus is disassembled.

7. The apparatus of claim 6, wherein each pole storage holder further comprises an upward opening channel member with a bottom, a first side, a second side, an outer end, and an open inner end for storing the horizontal poles and posts when not in use.

8. The apparatus of claim 1, wherein each of said left and right vertical bars are square.

9. The apparatus of claim 1, wherein each of said vertical posts and vertical bars have a pair of holes, and the left and right vertical bars are detachably secured to the first and second vertical posts by multiple horizontal pins and fasteners.

10. The apparatus of claim 1, wherein each rack assembly further comprises the first vertical post fitted over the right vertical bar, the second vertical post fitted over the left vertical bar, and the first and second vertical posts being detachably secured to the right and left vertical bars.

11. The apparatus of claim 10, wherein each rack assembly further comprises the vertical posts secured to the vertical bars with pins.

12. The apparatus of claim 1, wherein each rack assembly further comprising hooks staggered on opposite sides of the vertical posts, creating an inward-outward pattern, with the hooks in a position always perpendicular to the horizontal poles.

13. The apparatus of claim 1, wherein each rack assembly further comprises the left vertical bar and the right vertical bar attached to the base by welding.

14. The apparatus of claim 1, wherein each rack assembly further comprises the base, the horizontal handle, the left and right vertical bars, the first and second vertical posts, the horizontal poles, and the hooks being made of steel.

15. The apparatus of claim 1, further comprising a square tube, having multiple holes, positioned across at least two hooks in each rack assembly, a plywood board extending between the first and second rack assemblies, and multiple connecting pins extending through holes in the square tube and the plywood board for securing the board to the rack assemblies.

16. A method of drying multiple rigid, painted objects comprising the steps of attaching a first vertical post to a right vertical bar, attaching a second vertical post to a left vertical bar, setting a horizontal pole across hooks, and placing a first rack and a second rack an appropriate distance from each other to accommodate painted objects, thus creating a rack apparatus; inserting spikes in opposite ends of painted objects; and placing painted objects to be dried in the rack apparatus by resting the spikes extending out of painted objects on the horizontal bars.

17. A method of storing multiple rigid objects comprising assembling the rack apparatus as in claim 16, inserting spikes in opposite ends of objects; and placing objects in the rack apparatus by resting the spikes extending out of the objects on the horizontal bars.

* * * * *